United States Patent [19]

Stohlquist

[11] 4,301,843

[45] Nov. 24, 1981

[54] PACKAGING APPARATUS

[75] Inventor: Roger H. Stohlquist, Rockford, Ill.

[73] Assignee: Anderson Bros. Mfg. Co., Rockford, Ill.

[21] Appl. No.: 92,706

[22] Filed: Nov. 9, 1979

[51] Int. Cl.[3] ..... B65B 3/04

[52] U.S. Cl. ..... 141/172; 141/263; 141/275

[58] Field of Search ..... 141/129–191, 141/250–284, 67, 68, 114, 312–317, 369–373, 390, 374

[56] References Cited

U.S. PATENT DOCUMENTS

| | | | |
|---|---|---|---|
| 2,144,628 | 1/1939 | Hothersall | 141/263 |
| 2,612,016 | 9/1952 | Anderson | 53/518 |
| 3,172,435 | 3/1965 | Anderson et al. | 141/131 |
| 3,298,288 | 1/1967 | Anderson et al. | 493/309 |
| 3,364,651 | 1/1968 | Stohlquist | 53/266 R |

*Primary Examiner*—Houston S. Bell, Jr.
*Attorney, Agent, or Firm*—Vernon J. Pillote

[57] ABSTRACT

A packaging apparatus having a filling station, a downwardly opening nozzle at the filling station for dispensing a stream of semi-fluid material, means for advancing containers past the filling station, and container elevator means at the filling station for lifting a container into a position in which the upper portion of the container extends around the nozzle. Continuously driven container feed rollers are mounted at opposite sides of the nozzle and are operated in timed relation with the container elevator, first toward the nozzle to feed the container upwardly along the nozzle and then away from the nozzle to allow the container to move down as it is filled.

11 Claims, 4 Drawing Figures

Fig. 3
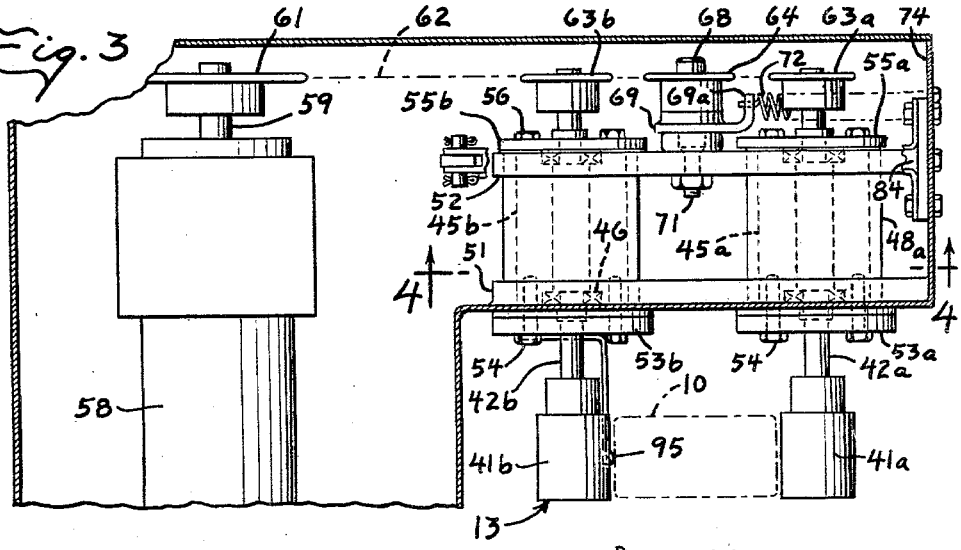
Fig. 2
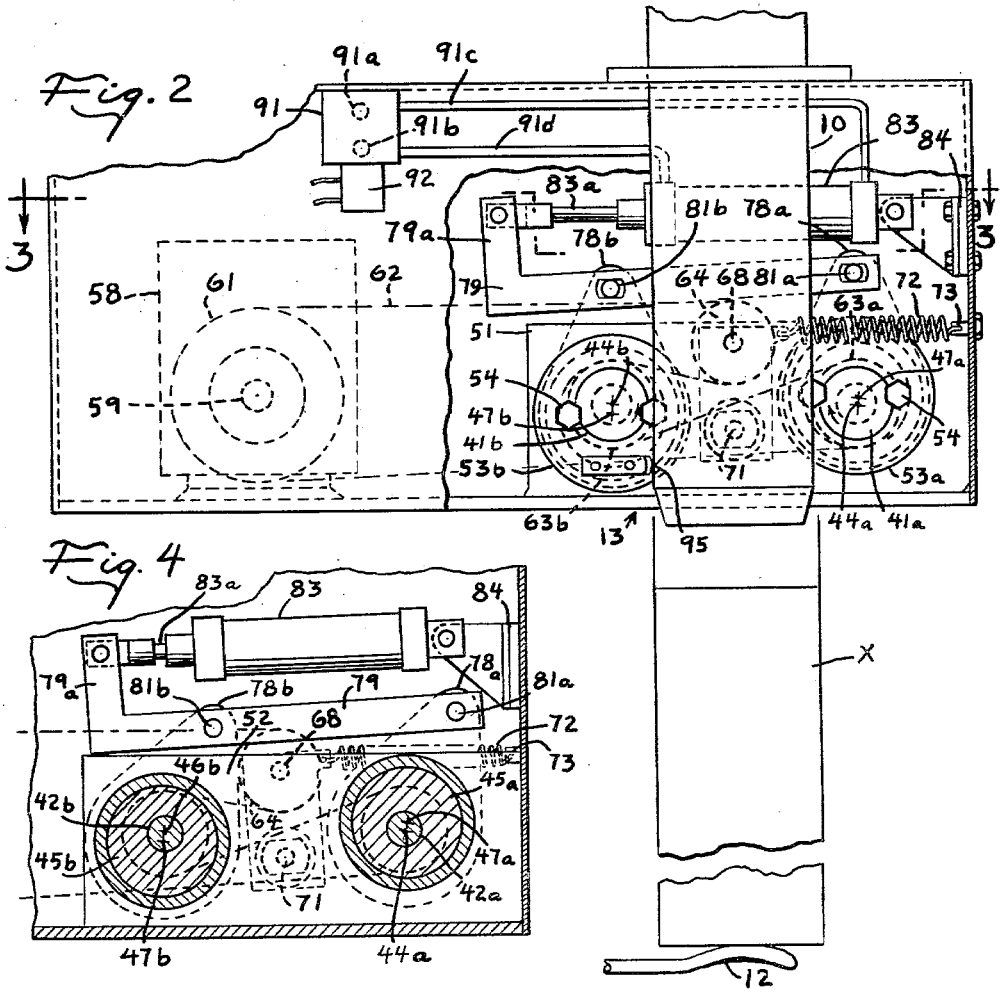
Fig. 4

PACKAGING APPARATUS

Packaging apparatus have heretofore been made, for example as shown in U.S. Pat. Nos. 2,612,016; 3,172,435; 3,298,288 and 3,364,651 having a downwardly opening nozzle at the filling station for dispensing a stream of semi-fluid material, a conveyor mechanism for advancing containers to a filling station below the nozzle, and an elevator mechanism for elevating a container at the filling station until the nozzle extends into the container. The container is allowed to move downwardly as it is filled and is thereafter moved crosswise of the nozzle and away from the filling station while a succeeding container is advanced into a position below the nozzle. While the prior filling apparatus as disclosed in the aforementioned patents works well with most containers, difficulties are encountered when attempting to fill very tall containers, particularly tall containers in which the transverse dimension of the containers is very small as compared to the height. With such tall, narrow containers, the semi-fluid material emerging from the nozzle contacts the walls of the containers and tends to bridge the space between the container walls as they are filled, resulting in pockets or void spaces in the containers.

It is the object of the present invention to overcome the problems encountered in the prior packaging apparatus when filling very tall containers, by providing a packaging apparatus having an auxiliary carton elevator means which is operative, when the cartons are raised to a position in which the upper end of the carton extends around the lower portion of the nozzle, to thereafter feed the carton upwardly along the nozzle so that the nozzle can fill the carton commencing at the lower portion of the carton.

Accordingly, the present invention provides, in a packaging apparatus having a downwardly opening nozzle at a filling station for dispensing a stream of semi-fluid material, a means for advancing containers along a path below the nozzle, and an elevator means at the filling station engageable with the container for elevating the container into a preselected raise position in which the upper portion of the container extends around the lower portion of the nozzle, the improvement comprising container feed roller means, means mounting the feed roller means for rotation about a generally horizontal axis alongside the nozzle and for shifting movement toward and away from the nozzle, means for driving the feed roller means in a direction to feed the carton upwardly along the nozzle, and means for shifting the feed roller means toward the nozzle to engage the container when the latter is elevated by the carton elevating means to said preselected raised position to thereby further elevate the container around the nozzle and for thereafter shifting the feed roller means away from the nozzle to allow the container to move downwardly as it is filled.

The feed roller means advantageously comprise a pair of feed rollers engageable with a container at relatively opposite sides of the nozzle.

A container fill brake is advantageously provided and which is operative to press the container against the nozzle as it is filled, to retard downward movement of the carton during filling.

These, together with other features and advantages of this invention will be more readily understood by reference to the following detailed description, when taken in connection with the accompanying drawings wherein:

FIG. 2 is a side elevational view of the auxiliary carton mechanism, with parts of the housing broken away to illustrate details of construction; taken on the plane 2—2 of FIG. 1;

FIG. 3 is a horizontal sectional view through the auxiliary carton mechanism, taken on the plane 3—3 of FIG. 2; and FIG. 4 is a fragmentary transverse sectional view taken on the plane 4—4 of FIG. 2.

Figure 1:
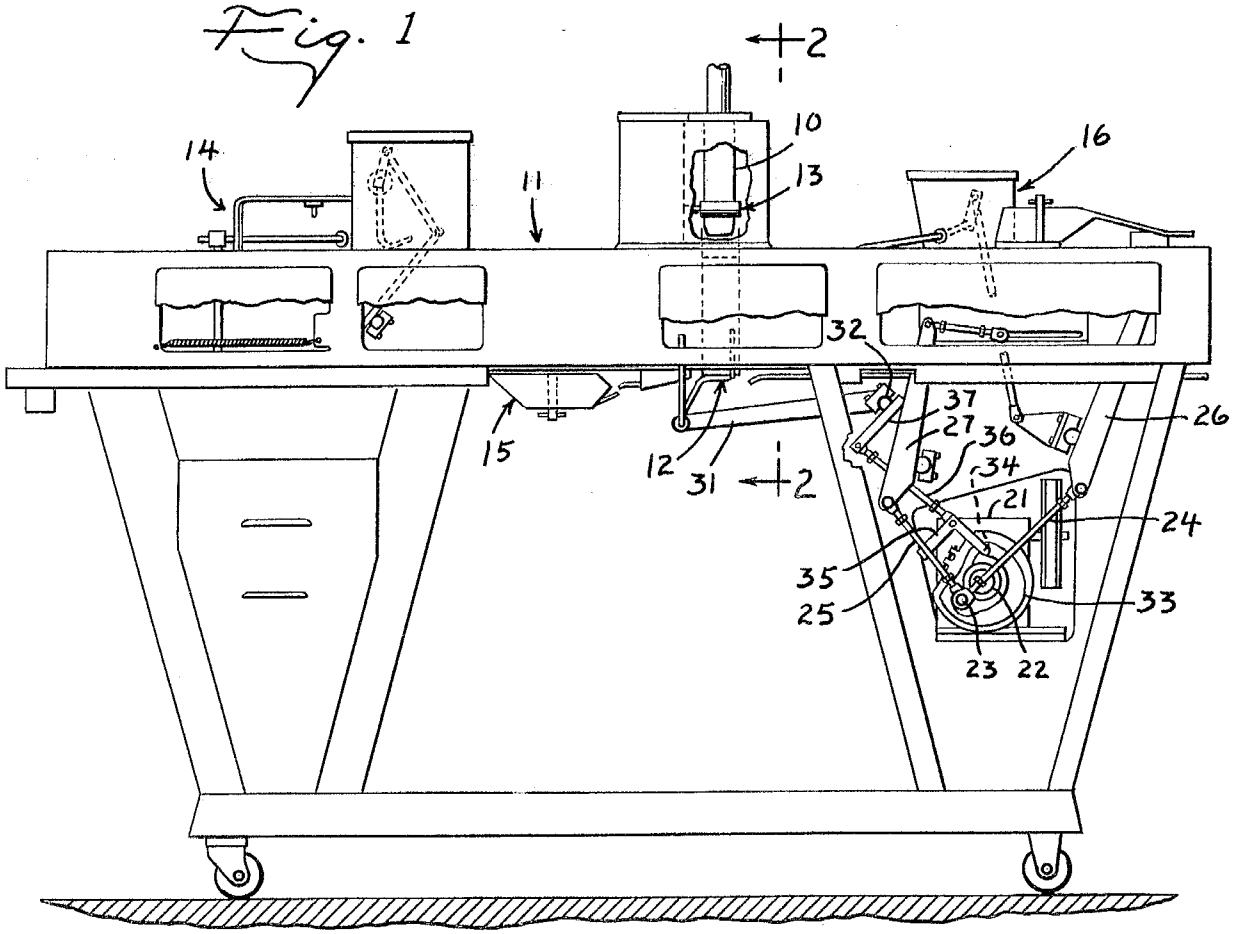
FIG. 1 is a rear elevational view of a packaging machine embodying the present invention.

The present invention relates to improvements in packaging machines of the type having a downwardly opening nozzle 10 at a filling station for dispensing a continuous stream of semi-fluid material such as ice cream, sherbert or the like, a container guide and conveyor means 11 for advancing containers along a path below the nozzle, and an elevator means 12 at the filling station engageable with the underside of the container for elevating a container into a raised position in which the upper portion of the container extends around the lower portion of the nozzle. In order to enable filling of very tall containers, the present invention provides an auxiliary container elevator means comprising container feed roller means 13 mounted for rotation alongside the nozzle and for shifting movement toward and away from the nozzle and driven in a direction to feed the container upwardly along the nozzle after it has been elevated by the carton elevator means.

The present invention is herein shown applied to a packaging apparatus of the type described in U.S. Pat. No. 3,364,651 issued Jan. 23, 1968 and entitled "Packaging Apparatus", to which reference is hereby made for a more complete disclosure of the construction and operation of the packaging apparatus. The packaging apparatus herein illustrated is the same as that disclosed in U.S. Pat. No. 3,364,651, except for modification in the height of the container guides and conveyor mechanism 11 to adapt the machine for handling tall cartons, and the modification in the length and cross-section of the filler nozzle 10 to correspond to the height and smaller cross-sectional shape of the tall, narrow cartons. As more fully disclosed in the aforementioned patent, the packaging apparatus is arranged to erect cartons initially supplied in a flattened condition, and to fill and close the cartons. For this purpose, the packaging apparatus has a carton infeed mechanism 14 for withdrawing flattened cartons from a carton magazine and for opening and erecting the cartons adjacent one end of the container guide and conveyor mechanism 11, and the conveyor operates to advance the erected cartons in step fashion along a path sequentially past a lower flap folding station 15, to a filling station below the nozzle. A carton elevator 12 is provided at the filling station for elevating the cartons to a position in which the upper portion of the carton extends around the nozzle and is arranged to allow the cartons to move downwardly as they are filled. The container guide and conveyor mechanism 11 also operate to move filled containers from the filling station past an upper flap folding station 16 to the delivery end of the packaging apparatus. The packaging apparatus is of the type which is cyclically operated in response to filling of a container at the filling station. As shown in FIG. 1, the packaging apparatus has a one revolution clutch 21 driven from a motor (not shown) and which is operative, when actuated, to drive its output shaft 22 through one revolution and then stop. The one revolution clutch is arranged to operate the conveyor mechanism 11 through one cycle and to operate the container elevator mechanism 12 in timed relation with the conveyor mechanism. The conveyor mechanism utilized in the aforementioned patent has reciprocating transfer members operated from a crank 23 connected to the output shaft 22 of the one revolution clutch, through links 24 and 25 and levers 26 and 27. The container elevator 12 is mounted on a lever 31 that is swingably supported on a shaft 32, and the carton elevator is operated in timed relation with the conveyor mechanism 11 by a cam 33 on the output shaft 22 of the one revolution clutch. As shown in FIG. 1, the cam is connected through a follower 34 on a lever 35 and through a link 36 to an arm 37 on the shaft 32. The crank 23 and cam 33 are so arranged that, when the one revolution clutch is actuated, the crank operates the conveyor mechanism to move a filled container away from the nozzle and to simultaneously move a succeeding empty container into a position below the nozzle, and the cam 33 is arranged to thereafter operate the elevator 12 to elevate the empty container at the filling station. As the carton at the nozzle is filled, it moves downwardly and, when the upper end of the carton reaches a level adjacent the lower end of the nozzle, a switch (not shown) is operated to actuate the one revolution clutch and drive the packaging machine through one cycle. As described in the aforementioned patent, the switch is conveniently operated in response to the position of the carton elevator mechanism.

The elevator mechanism 12 in the prior packaging machines was only adapted to elevate the cartons at the filling station a short distance until the upper portion of the container was in telescoping relation with the lower portion of the nozzle. This arrangement worked satisfactorily with the usual ice cream containers which have a relatively large cross-section and a height-to-minimum width ratio of less than two. However, difficulties were encountered in filling very tall containers and particularly very tall and narrow containers, for example containers having a height-to-minimum width ratio of five, six or more. The semi-fluid material emerging from the nozzle tends to adhere to the carton walls and, in tall narrow cartons, frequently bridged the space between the walls and caused the formation of pockets or void spaces in the filled carton. The auxiliary container feed roller means 13 are arranged to further elevate the container around the filler nozzle until the nozzle extends adjacent the lower portion of the tall container, to enable filling of the container to commence adjacent the lower portion of the container and progress upwardly as the container moves down along the nozzle.

The auxiliary carton elevator mechanism is best shown in FIGS. 2–4 and includes a pair of carton feed rollers 41*a* and 41*b* disposed at opposite sides of the nozzle 10. Feed rollers 41*a* and 41*b* are non-rotatably secured to the outer ends of the shafts 42*a* and 42*b* that are supported for rotation about their axes 44*a*, 44*b* on shaft support bushings 45*a*, 45*b* respectively. As shown in FIG. 3, bearings 46 are preferably provided to rotatably support the shafts on their respective bushings. Shaft support bushings 45*a* and 45*b* have a generally circular outer periphery, the axes 47*a* and 47*b* of which are eccentric to the respective shaft axis, and the shaft support bushings are supported for turning movement about their axes 47*a* and 47*b* in sleeves 48*a* and 48*b*. Headers 51 and 52 are secured to opposite ends of the sleeves 48*a* and 48*b* and support the same in fixed parallel relation. Front end plates 53*a* and 53*b* are secured as by fasteners 54 to the forward end of the shaft support bushings 45*a* and 45*b* and overlie the header 51 and rear end plates 55*a* and 55*b* are secured to the other ends of the shaft support bushings as by fasteners 56 and overlie the other header 52.

The rollers 41*a* and 41*b* are preferably driven continuously during operation of the packaging apparatus from a drive motor 58. Motor 58 has its output shaft 59 connected through a sprocket 61 and chain 62 to sprockets 63*a* and 63*b* on the shafts supporting 42*a* and 42*b* respectively. As shown in FIG. 2, the chain 62 extends from the top of sprocket 61 over an idler sprocket 64 then over the top of sprocket 63*b* and, from the bottom of sprocket 63*b* over the top of sprocket 63*a*, and then back to the underside of sprocket 61. In this manner, the motor 58 drives the rollers 41*a* and 41*b* in relative opposite directions, with roller 41*a* rotating clockwise and roller 41*b* rotating counterclockwise as viewed in FIG. 2. The rollers are provided with a friction surface and may, for example, be formed of rubber so that, when pressed against opposite sides of a container on the nozzle, they will feed the container upwardly along the nozzle. Motor 58 is advantageously of the adjustable speed type to enable adjustment of the speed at which the container feed rollers 41*a* and 41*b* are driven.

The idler sprocket 64 is supported for limited movement to take up slack in the chain 62 and is rotatably supported by suitable bearings on a pintle 68 secured to the upper end of an arm 69 that is pivotally mounted at its lower end by a pin 71 on the header 52. A tension spring 72 has one end attached to the upper end of the arm 69 as shown at 69*a*, and the other end attached to an anchor 73 on the housing 74. The spring 73 yieldably urges the sprocket 64 in a direction to take up the slack in the chain, as occurs when the spacing between the shaft sprockets 63*a* and 63*b* is changed.

Shifting of the rollers 41*a* and 42*b* toward and away from relatively opposite sides of the nozzle is effected by turning of the shaft support bushings 45*a* and 45*b* about their axes 47*a* and 47*b* respectively. The shaft support bushings 45*a* and 45*b* are normally positioned as shown in FIG. 2 with the bushing axis 47*a* above the shaft axis 44*a* and with the bushing axis 47*b* below the shaft axis 44*b*. The cover plates 55*a* and 55*b* are provided with upwardly extending ears 78*a* and 78*b* and a link 79 is pivotally connected at 81*a* and 81*b* to the ears 78*a* and 78*b* to turn the shafts support bushings in unison and in the same direction. A double action fluid cylinder 83 is mounted at one end by a bracket 84 on the housing and has its rod 83*a* connected to an arm 79*a* on the link 79. As will be seen from FIGS. 2 and 4, the cylinder 83 is operative when extended to position the shaft support bushings 45*a* and 45*b* in the position shown in FIG. 2 with the feed rollers 41*a* and 41*b* spaced from the nozzle 10, and is operative when retracted as shown in FIG. 4, to turn the shaft support bushing in a direction to shift the roller shafts 42*a* and 42*b* toward the relatively opposite sides of the filler nozzle 10 until the feed rollers press the container sides against the nozzle.

The cylinder 83 is actuated in timed relation with the elevator 12, to move the carton feed rollers 41*a* and 41*b* toward the nozzle when the carton elevator 12 elevates the carton at the filling station to a position in which the upper portion of the carton extends around the nozzle at a level adjacent the feed rollers 41*a* and 41*b*. The cylinder maintains the feed rollers in engagement with the carton at opposite sides of the nozzle for a short time interval sufficient to elevate the container until the nozzle extends adjacent the lower portion of the container and the cylinder is then operated back to its position shown in FIG. 2 to disengage the feed rollers from the carton and allow the carton to move downwardly along the nozzle as it is filled. As diagrammatically shown in FIG. 2, the flow of fluid to the cylinder 83 is controlled by a four way valve 91 having an electro-responsive actuator 92. When the valve actuator 92 is de-energized, fluid controlled by the valve 91 moves the cylinder 83 to its extended position shown in FIG. 2. The valve has an inlet port 91*a* connected to a source of fluid pressure; an exhaust port 91*b* and first and second controlled outlet ports enhanced through lines 91*c* and 91*d* to opposite ends of cylinder 83. Energization of the valve actuator 92 to retract the cylinder 83, is controlled by a switch (not shown) actuated when the elevator 12 is moved to its raised position. Conveniently, the valve control switch can be operated by a cam (not shown) drivingly connected to the output shaft 22 of the one revolution clutch. The switch operating cam on the output shaft 22 is arranged to energize the valve actuator 92 for a short time interval sufficient to enable the carton feed rollers 41*a* and 41*b* to elevate the container to the desired position along the nozzle. The speed of the variable speed drive motor 58 can be adjusted to control the distance that the feed rollers elevate the containers, during the interval that the valve actuator 92 is energized.

A carton fill brake 95 is provided for controlling downward movement of the carton during filling. The fill brake is conveniently in the form of a resilient finger having a curved nose portion as shown in FIG. 2, and which is adapted to press the carton against the side of the nozzle with sufficient friction to control downward movement of the carton during filling. The carton brake is advantageously mounted on cover plate 53*b* for movement therewith, into and out of a position pressing the carton against the nozzle. As shown in FIGS. 2 and 3, the carton fill brake 95 is mounted on the cover plate 53*b* at a location below the axis 47*b* of shaft support bushing 45*b* and such as to press the carton against the nozzle with sufficient pressure to retard downward movement of the carton, when the rollers are spaced from the nozzle as shown in FIG. 2. When the cylinder 83 is thereafter actuated to press the rollers 41*a* and 41*b* against relatively opposite sides of the carton at the nozzle, the brake 95 is shifted away from the nozzle and out of engagement with the carton so that it does not retard elevation of the carton.

From the foregoing it is thought that the construction and operation of the packaging apparatus will be readily understood. The one revolution clutch 21 is actuated when a container at the filling station moves down to a position in which the upper end of the container is adjacent the lower end of the nozzle. Clutch 21, when actuated, drives its output shaft 22 through one revolution and crank 23 operates the conveyor mechanism 11 to move a filled container away from the filling station and to move a succeeding empty container to the filling station. As the shaft 22 rotates, the cam 33 operates the carton elevator 12 to raise a container X at the filling station into a position in which the upper end of the container extends around the lower portion of the nozzle. At about the same time as the elevator 12 raises the container, a cam on the shaft 22 operates a switch to energize valve actuator solenoid 92. Valve 91 then applies pressure to cylinder 83 to move the rollers from the position shown in FIG. 2 to the position shown in FIG. 4, to thereby press the feed rollers 41*a* and 41*b* against the carton on the nozzle. The rollers 41*a* and 41*b* are continuously driven by the motor 58 to elevate the container X along the nozzle and the speed of the motor can be adjusted to control the height to which the container can be elevated. When the cam on shaft 22 deactivates the valve control switch, the solenoid 92 is de-energized and the feed rollers 41*a* and 41*b* move away from the nozzle. The container fill brake 95 is moved into engagement with the carton on the nozzle when the rollers are moved away from the nozzle as shown in FIG. 2, to control downward movement of the container during filling. Very tall and narrow containers, for example rectangular cartons having a height of about 28 cm, a width of about 9 cm and a depth of about 4 cm have been successfully filled with semi-frozen ice cream without encountering problems with pockets or void spaces in the filled cartons.

The embodiments of the invention in which an exclusive property or privilege is claimed are defined as follows:

1. In a packaging apparatus having a filling station, a downwardly opening nozzle at the filling station for dispensing a stream of semi-fluid material, means for advancing containers along a path below the nozzle, container elevator means at the filling station engageable with the underside of a container for elevating a container into a preselected raised position in which the upper portion of the container extends around the lower portion of the nozzle, the improvement comprising container feed roller means, means mounting the feed roller means for rotation about a generally horizontal axis alongside the nozzle and for shifting movement toward and away from the nozzle, means for driving the feed roller means in a direction to feed a container upwardly along the nozzle, and means for shifting the feed roller means toward the nozzle to engage a container when the latter is elevated by the container elevator means to said preselected raised position to further elevate the container around the nozzle and for thereafter shifting the feed roller means away from the nozzle to allow the container to move downwardly as it is filled.

2. A packaging apparatus according to claim 1 including container fill brake means for pressing a portion of the container against the nozzle to retard downward movement of the container during filling.

3. A packaging apparatus according to claim 1 including container fill brake means, means operative when the feed roller means is moved away from the nozzle for moving the container fill brake means toward the nozzle to press the container against the nozzle and retard downward movement of the container during filling and operative when the feed roller means is moved toward the nozzle for moving the container brake means away from the nozzle.

4. A packaging apparatus according to claim 1 including means for operating said means for shifting the feed roller means in timed relation with the operation of said container elevator means.

5. In a packaging apparatus having a filling station, a downwardly opening filling nozzle for dispensing a stream of semi-fluid material, means for advancing containers along a path below the nozzle, container elevator means at the filling station engageable with the underside of a container for elevating a container into a preselected raised position in which the upper portion of the container extends around the lower portion of the nozzle, the improvement comprising, first and second container feed roller means, means mounting the first and second feed roller means for rotation about generally horizontal axes along opposite sides of the nozzle and for shifting movement toward and away from the nozzle, means for driving the first and second feed roller means in relatively opposite directions and such as to feed a container upwardly along the nozzle, and means for shifting the first and second feed roller means toward the nozzle to engage a container when the latter is elevated by the container elevator means to said preselected raised position to further elevate the container around the nozzle and for thereafter shifting the first and second feed roller means away from the nozzle to allow the container to move downwardly.

6. A packaging apparatus according to claim 5 including container fill brake means for pressing a portion of the container against the nozzle to retard downward movement of the container during filling.

7. A packaging apparatus according to claim 5 including container fill brake means, means operative when the feed roller means is moved away from the nozzle for moving the container fill brake means toward the nozzle to press the container against the nozzle and retard downward movement of the container during filling and operative when the feed roller means is moved toward the nozzle for moving the container brake means away from the nozzle.

8. A packaging apparatus according to claim 5 wherein said means for shifting the first and second feed roller means comprises, first and second shaft support means, first and second shafts each mounted for axial rotation on the respective first and second shaft support means, and means mounting the first and second shaft support means for turning about a support axis eccentric to the axis of the respective first and second shafts, and actuator means for turning the first and second shaft support means about their support axis to shift the first and second shafts toward and away from each other.

9. A packaging apparatus according to claim 8 wherein the support axis of the first shaft support means is located above the axis of the first shaft and the support axis of the second shaft support means is located below the second shaft axis, and said actuator means is arranged to simultaneously turn both shaft support means in the same direction.

10. A packaging apparatus according to claim 9 including carton fill brake means mounted on said second shat support means at a location below its support axis for movement toward the nozzle to press the container against the nozzle when the second feed roller means is moved away from the nozzle.

11. A packaging apparatus according to claim 7 including means for operating said actuator means in timed relation to said container elevator means.

* * * * *